United States Patent [19]

Schieman

[11] 3,977,964

[45] Aug. 31, 1976

[54] STABILIZATION OF HYDROCRACKED LUBE OILS

[75] Inventor: Richard D. Schieman, Avon Lake, Ohio

[73] Assignee: Standard Oil Company, Cleveland, Ohio

[22] Filed: Mar. 7, 1975

[21] Appl. No.: 556,345

[52] U.S. Cl. ..... 208/327; 208/19; 208/96

[51] Int. Cl.[2] ..... C10G 21/16

[58] Field of Search ..... 208/18, 19, 96, 327

[56] References Cited

UNITED STATES PATENTS

| | | | |
|---|---|---|---|
| 3,095,366 | 6/1963 | Schieman | 208/19 |
| 3,247,096 | 4/1966 | Conwell | 208/96 |
| 3,506,565 | 4/1970 | White et al. | 208/18 |

*Primary Examiner*—Herbert Levine

*Attorney, Agent, or Firm*—John F. Jones; Sherman J. Kemmer

[57] ABSTRACT

A process for the production of lubricating oil base which is stable to ultraviolet light, which comprises extracting a mixture of a hydrocracked oil and decanted oil with furfural.

5 Claims, No Drawings

STABILIZATION OF HYDROCRACKED LUBE OILS

This invention relates to a process for the production of lubricating oil base and more particularly pertains to a process for the production of a lubricating oil which is stable to degradation by ultraviolet light by extracting a hydrocracked oil with an extractant which is composed of furfural and a decanted oil.

Lubricating oils, which are hydrocarbons boiling above about 600°F, have traditionally been produced by one of three methods. The first, which produces straight-run lubricating oils, may include steps of distillation of a crude oil, solvent refining, solvent dewaxing, acid treating, and clay contacting. Solvent refining is generally employed to separate the lubricating oil components from the other components of the distilled oil.

The second method is somewhat similar to the first but substitutes mild hydrofining or hydrofinishing for one or more of the steps of solvent refining, acid treating or clay contacting. Hydrofining or hydrofinishing is a process wherein the contaminants in the crude distillate are converted, by contacting with hydrogen in the presence of a hydrogenating catalyst, to easily removable or harmless species.

A third method, more fully described in U.S. Pat. No. 3,546,098, involves the production of lubricating oils from hydrocracked oils. In this process, a heavy petroleum oil is contacted with hydrogen at an elevated temperature and pressure in the presence of a hydrocracking catalyst, and the hydrocracked product (hydrocrackate) is separated usually by distillation into fractions boiling in different temperature ranges. One or more of these materials will boil within the lubricating-oil range. These hydrocracked oils, which are within the boiling range of lubricating oils, are then extracted with anhydrous or aqueous N,N-dimethylformamide or dimethylsulfoxide to produce ultraviolet-light-stable lubricating oils.

Lubricating oils produced by hydrocracking, per se, although having many desirable properties not otherwise obtainable by straight-run processing, also possess to a significant degree one undesirable property, which is the instability when exposed to ultraviolet light in the presence of air. This instability is evidenced by the formation of a precipitate in the oil after a short period of exposure to ultraviolet light. Such a precipitate is undesirable, not only because it may prove detrimental to the lubrication function which the oil is to perform but also because it reduces the esthetic value of what would otherwise be a clear, premium-quality oil.

Certain types of lubricating-oil instability, such as oxidation instability, have been improved in the past by treating the oil with a number of polar solvents, including furfural. Furfural treatment of straight-run oils, however, is not selective, i.e., it has the disadvantage that it also removes a considerable portion of the desirable lubricating-oil components along with the undesirable components. I have discovered that mixtures of furfural and decanted oil will selectively extract the undesirable components from hydrocracked oil leaving substantially all of the desirable lubricating-oil components behind.

I have now unexpectedly discovered a process for removing substantially all of the instability-causing materials from hydrocracked oils, leaving high yields of lubricating oils which have excellent ultraviolet stability which comprises contacting a mixture of a lubricating-oil fraction from a hydrocracked oil and a decanted oil in a contacting apparatus with furfural and recovering from the effluent of said contacting apparatus a lubricating oil having an improved ultraviolet-light stability.

The contact treating of the hydrocracked oil-decanted oil mixture with the furfural is conducted at a temperature of from about 95° to 150°F and pressures of from about atmospheric up to about 100 atmospheres. Preferably, the pressure is from about 0 to 100 psig. The contact treating may be single stage or multistage with the latter preferred. Ratios of the hydrocracked oil-decanted oil-to-furfural mixture are within the range of 0.75 to 1 to 1.5 to 1 and preferably about 1 to 1 on a volume basis. The hydrocracked oil-to-decanted oil ratio should be between 4 to 1 and 1 to 1, respectively. The process of this invention results in excellent yields of stable lubricating oil.

The hydrocracked oil useful in the present invention is produced by contacting in a hydrocracking zone a liquid hydrocarbon feedstock containing a substantial portion of components boiling above 750°F with hydrogen in the presence of a hydrocracking catalyst at an elevated temperature and pressure in order to convert at least 15 weight percent of said feedstock components boiling above 750°F to materials boiling below 750°F, and recovering from the effluent of said hydrocracking zone a lubricating-oil fraction boiling above 600°F. Preferred feeds for hydrocracked oils are lubricating stocks boiling above 900°F, although crude oils, reduced crudes, residual oils, and the like, may be used.

Decanted oil (also sometimes called slurry oil) useful in the process of this invention is a very inexpensive oil which is separated from catalytically cracked hydrocarbon material by pouring it off the top (decanting) of the bottoms from the catalytic-cracking unit. The bottoms from the catalytic-cracking unit are allowed to stand in a settling unit to allow residual catalyst fines present in the bottoms to settle before the decanted oil is removed therefrom.

In my process, I have discovered that the use of furfural-decanted oil mixtures to contact hydrocracked oil not only removes undesirable materials from the hydrocracked oil, but unexpectedly on the order of 30% by volume of the decanted oil components end up in the final ultraviolet-light-stable lubricating oil.

One test for ultraviolet stability possessed by an oil is the determination of the relative amount of time required for a precipitate to form upon exposure of the oil to ultraviolet light. One obvious way to measure this degree of stability is to expose the oil to the ultraviolet light in sunlight and observe the number of days required for a precipitate to form. A more exact test has been devised for determining the ultraviolet-light stability of oil and is described in U.S. Pat. No. 3,546,098. This test, which I have used in determining the ultraviolet-light stability of the lubricating oils produced by the process of my invention, involves placing a 5-ml. sample of the oil to be tested in a borosilicate glass container and exposing this sample to a 450-watt mercury-vapor ultraviolet light (type L) in a closed cabinet maintained at a temperature of 140°F. The oil sample is spaced 2 inches from the light source. The time in hours required for formation of precipitate in the oil sample is determined. Oils which form a precipitate in less than 4 hours' exposure are considered to be too unstable to be commercially acceptable. Oils which form precipitates in more than 4 but less than 10 hours are considered to be reasonably stable and marginally acceptable, although inferior, and those which require more than 10 hours' exposure before precipitate forms are considered to be of premium quality.

In the contacting of the hydrocracked oil with the furfural-decanted oil mixture, any conventional liquid-liquid contacting apparatus is suitable for use so long as it provides substantially complete contacting of the oil and treating-agent components.

When hydrocracked oils contain waxy components, they may be removed by conventional dewaxing. The dewaxing may be done before or after the extraction step described herein.

EXAMPLES 1–5

In these examples, the hydrocracked oil was dewaxed in each case following the extraction step. Examples 1–3 are outside the scope of the present invention showing furfural extractions which were carried out at 200°F in order to take full advantage of furfural as an extractant. Examples 4–5 are within the scope of the present invention. The extraction temperature in Example 4 was 107°F and in Example 5 was 104°F. The results are listed in the table. It is apparent from the ultraviolet-light stability data given in the table for these examples that the process of this invention gives unexpectedly superior ultraviolet-light stability in the treated oil.

Examples 1–5

| | Example | | | | |
|---|---|---|---|---|---|
| | 1 | 2 | 3 | 4 | 5 |
| Hydrocracked Oil 700–1050°F (volume) | 100 | 100 | 100 | 66.7 | 66.7 |
| Decanted Oil (volume) | 0 | 0 | 0 | 33.3 | 33.3 |
| Furfural-to-Oil Volume Ratio | None. | 0.5 to 1 | 1 to 1 | 0.5 to 1 | 1 to 1 |
| Product Oil Quality | | | | | |
| Viscosity 100°F Cst. | 41.86 | 42.99 | 44.38 | 33.83 | 31.42 |
| Viscosity Index | 105 | 108 | 104 | 109 | 104 |
| Ultraviolet Stability | 1 hr. | 20.5 hrs. | 64 hrs. | 28.5 hrs. | 448+ hrs. |

It is apparent that inclusion of decanted oil in the hydrocracked oil gives a superior lubricating-oil product when compared with the product of extraction of hydrocracked oil with furfural alone.

The preceding examples and descriptions are given for illustrative purposes only. It is apparent that there are many embodiments of the process of this invention, and it is not intended that it be limited other than as described in the appended claims.

I claim:

1. A process for production of a lubricating oil which is stable in the presence of ultraviolet light which comprises extracting a hydrocracked oil-decanted oil mixture with furfural as an extractant in a contacting apparatus and recovering from the effluent from said contacting apparatus a lubricating oil having improved ultraviolet-light stability.

2. The process of claim 1 wherein the ratio by volume of hydrocracked oil to decanted oil is within the range of 4 to 1 and 1 to 1, respectively.

3. The process of claim 2 wherein the ratio by volume of oil mixture to furfural is within 0.5 to 1 to 1.5 to 1, respectively.

4. The process of claim 3 wherein the extracting is carried out at a temperature in the range of from about 95° to 150°F.

5. The process of claim 4 wherein there is also included a dewaxing of the hydrocracked oil.

* * * * *